US008267844B2

(12) United States Patent
Kassel et al.

(10) Patent No.: US 8,267,844 B2
(45) Date of Patent: Sep. 18, 2012

(54) GRIPPING DEVICE

(76) Inventors: Arthur Michael Kassel, Beverly Hills, CA (US); Kenneth Owen Richardson, Whittier, CA (US)

( * ) Notice: Subject to any disclaimer, the term of this patent is extended or adjusted under 35 U.S.C. 154(b) by 781 days.

(21) Appl. No.: 11/293,479

(22) Filed: Dec. 2, 2005

(65) Prior Publication Data

US 2006/0084557 A1 Apr. 20, 2006

Related U.S. Application Data

(63) Continuation of application No. PCT/US2004/018004, filed on Jun. 4, 2004.

(60) Provisional application No. 60/475,622, filed on Jun. 4, 2003.

(51) Int. Cl.
*A63B 71/08* (2006.01)
*A63B 71/14* (2006.01)

(52) U.S. Cl. ..... 482/139; 482/49

(58) Field of Classification Search ..... 482/139, 482/93, 44, 49, 50; 602/64; 623/61, 62; 2/16, 158–162

See application file for complete search history.

(56) References Cited

U.S. PATENT DOCUMENTS

| | | | | |
|---|---|---|---|---|
| 4,400,831 | A | 8/1983 | Rietz | |
| 4,484,740 | A * | 11/1984 | Green | 482/105 |
| 4,487,412 | A * | 12/1984 | Meeko | 482/139 |
| 4,684,122 | A * | 8/1987 | Desmond et al. | 482/105 |
| 4,793,005 | A * | 12/1988 | Hetzel, Jr. | 2/161.1 |
| 4,807,876 | A * | 2/1989 | Lothar | 482/139 |
| 5,009,416 | A * | 4/1991 | Caruthers | 482/139 |
| 5,298,001 | A | 3/1994 | Goodson | |
| 5,350,343 | A * | 9/1994 | DaSilva | 482/106 |
| 5,362,295 | A | 11/1994 | Nurge | |
| 5,456,650 | A | 10/1995 | Williams, Jr. et al. | |
| 5,527,244 | A | 6/1996 | Waller et al. | |
| 5,685,809 | A * | 11/1997 | Murray | 482/105 |
| 5,704,883 | A * | 1/1998 | Eckmann | 482/105 |
| 5,846,168 | A * | 12/1998 | Murray | 482/105 |
| 6,183,400 | B1 * | 2/2001 | Pope | 482/92 |
| 6,849,036 | B2 * | 2/2005 | Forslid | 482/139 |
| 2005/0255973 | A1 * | 11/2005 | Ward | 482/93 |

FOREIGN PATENT DOCUMENTS

| | | |
|---|---|---|
| WO | 02/087708 | 11/2002 |
| WO | WO 2004/108230 A1 | 12/2004 |

* cited by examiner

*Primary Examiner* — Loan Thanh
*Assistant Examiner* — Sandhara Ganesan
(74) *Attorney, Agent, or Firm* — Howard M. Cohn

(57) ABSTRACT

The present invention relates to a gripping device that removably attaches onto a user's wrist to enable the user to grip onto a handle. The gripping device comprises a wrist-wrapping, elongated belt portion having opposite ends, and a gripping structure that extends outward from the plane of the belt portion.

8 Claims, 2 Drawing Sheets

GRIPPING DEVICE

CROSS-REFERENCE TO RELATED APPLICATIONS

This application claims the benefit of U.S. Provisional Patent Application No. 60/475,622 filed on Jun. 4, 2003 which is incorporated herein by reference.

This application is a continuation of copending PCT Patent Application No. PCT/US2004/018004 filed on Jun. 4, 2004, which is incorporated herein by reference.

TECHNICAL FIELD

The present invention relates generally to a gripping device that removably binds onto a user's wrist and that is especially adapted to enable the user to grip onto an exercise device.

BACKGROUND OF THE INVENTION

It has long been known that for individuals who have limited mobility of their limbs, regular exercise can provide significant benefits. Such individuals, who may have suffered a spinal injury, stroke, multiple sclerosis (MS), muscular dystrophy (MD), or other similar injury or disorder that impairs mobility (either temporarily or permanently), may also find that their impairments can even present significant obstacles to exercising other relatively unaffected body parts.

Regular movement of all major body parts has been shown to be necessary to promote the comfort, health and general well-being of individuals suffering from such disabilities. A failure to do so can have painful, even unhealthful and dangerous consequences. For example, immobility tends to lead rapidly to stiffened and painful joints and tendons. In the longer term, atrophy of unused and underused muscles can occur. A greater susceptibility to the formation of blood clots has been demonstrated. Long-term immobility also leads to an overall deterioration of the cardiovascular system.

By way of contrast, when impaired limbs are regularly exercised (e.g., when subjected to repeated manual extensions by a physical therapist), joints tend to become more flexible, circulation is improved, the tendency to atrophy is reduced, the heart tends to work more efficiently, and the patient tends to experience less pain and discomfort. While the benefit of such exercise is indisputable, it can require considerable time and effort of both the afflicted individual and the assistant (therapist or volunteer).

The problem is that many types of exercise equipment require a user to hold onto the handles of the machine. For users that have an injury or disorder that impairs mobility (either temporarily or permanently) of their hands, they often can't hold onto the handles, and thus their impairment can present a significant obstacle to exercising.

SUMMARY OF THE INVENTION

According to the present invention, a gripping device that removably attaches onto a user's wrist to enable the user to grip onto a handle, comprises a wrist-wrapping, elongated belt portion having opposite ends and a gripping structure that extends outward from the plane of the belt portion.

Also according to the present invention, the elongated belt portion is generally formed from a flexible strip of material. The flexible strip of material is selected from a material selected from the group comprising leather, plastic or cloth.

Further, according to the present invention, the gripping structure has a lower section, an upper section and a free end section. The gripping structure has a lower section encased in the belt portion.

Still further, according to the present invention, the upper end section has a centerline Ca-La disposed at an angle a of between 2 and 30 degrees with respect to a centerline C-L extending through the lower end section of the gripping structure.

Yet further, according to the present invention, the gripping structure is stiff and relatively rigid. The gripping structure component is formed of a material selected from the group comprising metal and plastic and can be adjusted to change the curvature between the upper section and the lower section.

Also according to the present invention, the free end section of the gripping device curves from and is of a unitary construction with upper section and has an end that generally extends in a direction towards the belt portion.

Still further, according to the present invention, the lower section is disposed or encased within the flexible strip of material forming the gripping device.

According to the present invention, there is disclosed a method of removably attaching a gripping device to a user's wrist to enable the user to grip onto a handle. The method comprises the steps of: providing a gripping structure having a wrist-wrapping, elongated belt portion with opposite ends and a gripping structure including a lower section, an upper section and a partially curved end section that extends outward from the plane of the belt portion; and placing the user's hand so that the one side of the belt portion of the gripping device rests against the user's wrist and the user's hand extends over the curved end portion.

Also according to the present invention, the method includes the steps of: wrapping a first end of the elongated belt portion around the back of the wrist of the user so that a first strip connecting gripping material is disposed directly on the back of the user's wrist opposite the palm of the hand; and wrapping a second opposite end of the elongated belt portion so that a second strip of connecting material overlaps the first strip and they are locked together.

BRIEF DESCRIPTION OF THE DRAWINGS

Reference will be made in detail to preferred embodiments of the invention, examples of which may be illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the figures may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Figure 1:
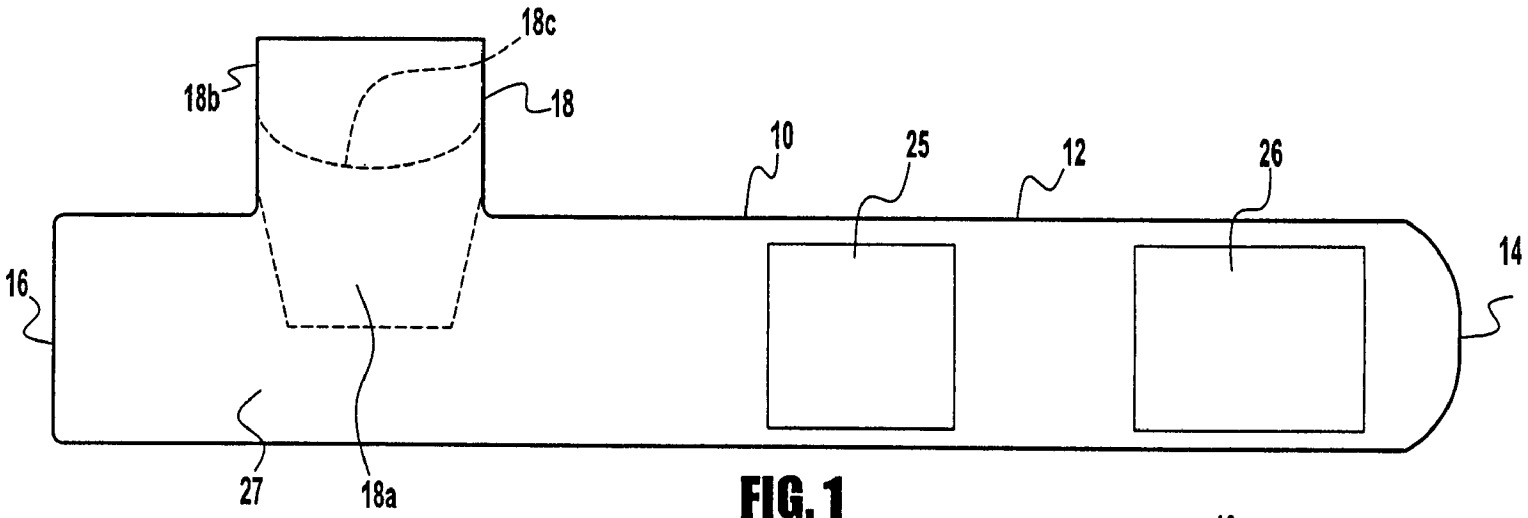
Figure 2:
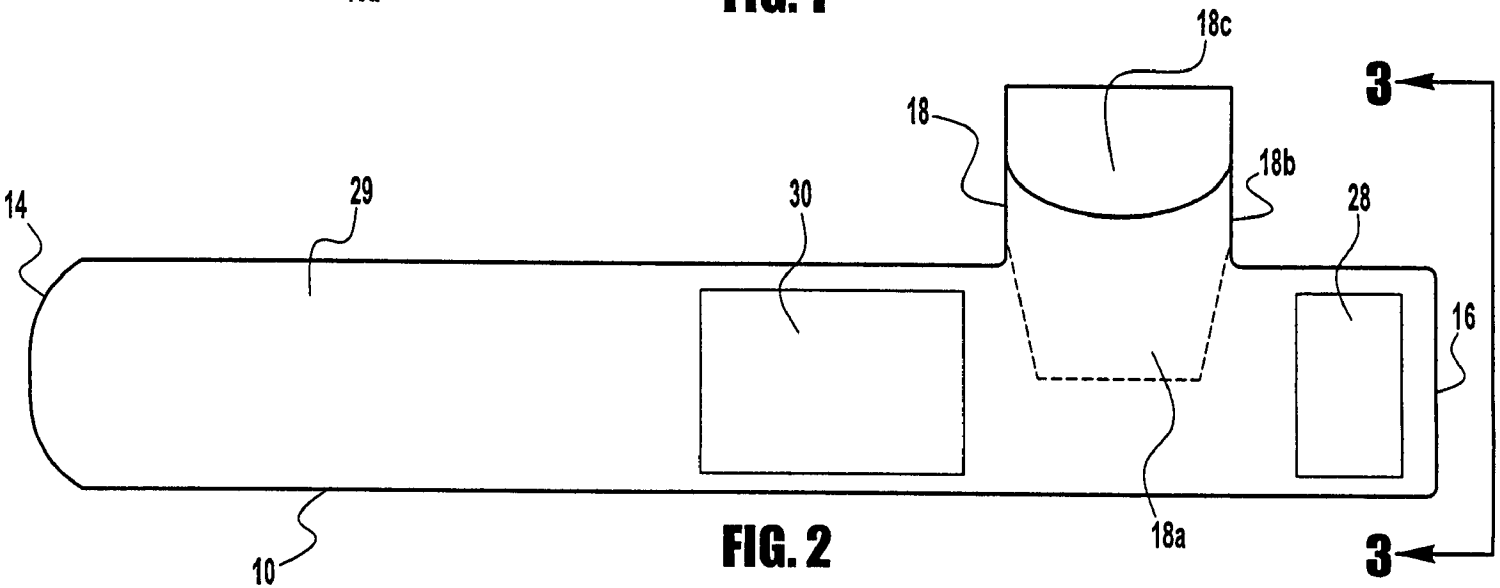
Figure 3:
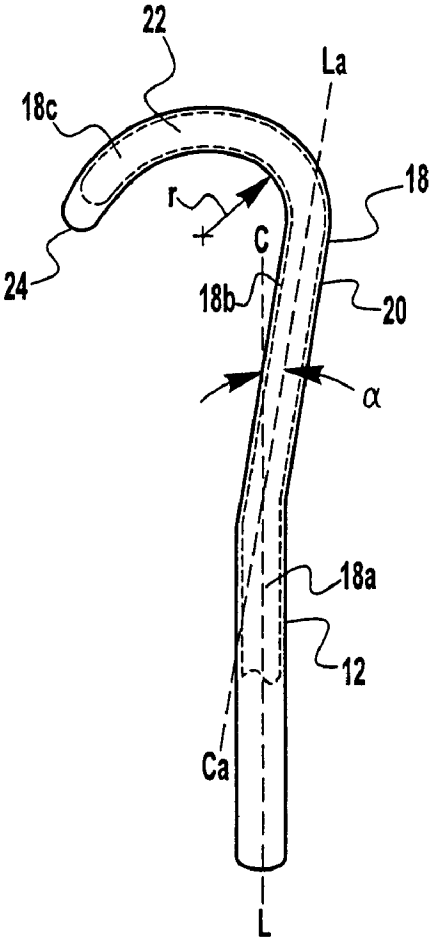

The structure, operation, and advantages of the present preferred embodiment of the invention will become further apparent upon consideration of the following description taken in conjunction with the accompanying figures, wherein:

FIG. 1 is a top view of the gripping device of the present invention;

FIG. 2 is a bottom view of the gripping device of the present invention;

FIG. 3 is a side view of the gripping device of the present invention; and

Figure 4:
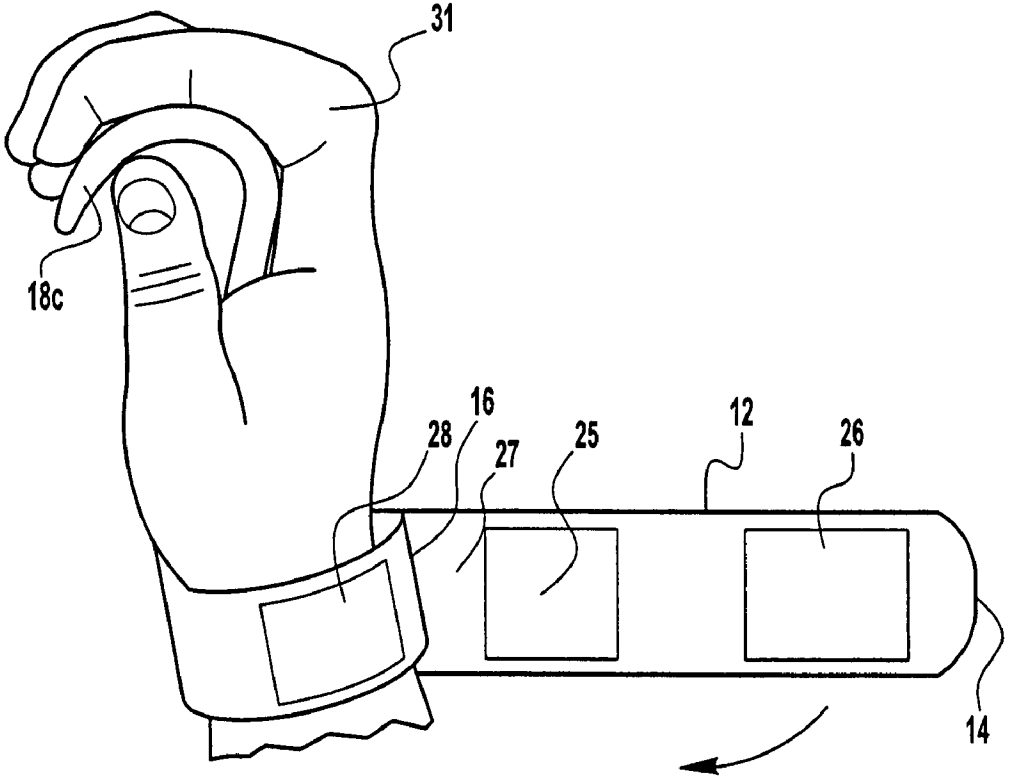

FIG. 4 is a three-dimensional view of the gripping device partially attached to the wrist of a user.

DETAILED DESCRIPTION OF THE INVENTION

Referring to FIG. 1, there is shown a top view of the gripping device 10. The gripping device 10 includes a wrist-wrapping, elongated belt portion 12 having opposite ends 14, 16, and a gripping structure 18 that extends outward, as shown in FIGS. 1 and 2, from the plane of the belt portion 12. The belt portion 12 is generally formed from two strips of flexible strip of material, such as for example, leather, plastic or cloth. The gripping structure 18 has a lower section 18*a*, an upper section 18*b* and a free end section 18*c*. The lower end section 18*a* can be encased between the two strips of material forming the belt portion 12.

As shown in FIG. 3, the upper end section 18*b* has a centerline Ca-La disposed at an angle a of between about 2 degrees and 30 degrees and preferably about 15 degrees and 25 degrees with respect to the centerline C-L extending through the lower end section 18*a* of gripping structure 18. Typically, the gripping structure or component 18 is stiff and relatively rigid. The upper section 18*b* projects upward from belt portion 12 and has a free end section 18*c* that curves and is of a unitary construction with upper section 18*b*. The free end section 18*c* has a tip 24 that points in a direction towards the elongated belt portion 12 of the gripping device 10. While the curvature of the gripping component forms a generally semi-circular shape, the shape could be more or less semi-circular depending on the preference of the user or the shape of the handle to which it is engaged. Typically, the gripping component 18 is constructed of a metal insert disposed or encased within the two strips of flexible material of the gripping device 10. When the gripping structure 18 is formed of a metal insert, it can be adjusted to change the curvature between the upper section 18*b* and the lower end section 18*a* or the angle between the free end 18*c* and the upper section 18*b* to accommodate different shaped or sized hands or different shaped or sized exercise handles. Typically, the radius of curvature r is approximately ½ inch to 1 inch and preferably about ¾ of an inch. While the gripping component 18 can be formed with a metal insert, it is also within the terms of the invention to form it of a rigid material such as plastic, and either cover it or allow it to protrude outward from the belt portion 12 of the gripping device 10.

Referring again back to FIG. 1, which shows one side 27 of the gripping device 10, there are disposed two strips 25 and 26 of a gripping material, such as for example Velcro-type gripping material. On the opposite side 29 of the gripping device 10, as shown in FIG. 2, there are two additional strips 28, 30 of Velcro-type gripping material.

To attach the gripping device 10 onto a person's hand 30, as shown in FIG. 4, first the person places their hand so that the one side 27 of the belt portion 12 of the gripping device 10 rests against the user's wrist and the hand 31 extends over the curved end portion 18*c* of the gripping device. Then, the end 16 of the elongated belt portion 12 is wrapped around the back of the wrist of the user so that the strip 28 of connecting gripping material is disposed directly on the back of the user's wrist opposite the palm of the hand. Next, the other end 14 of the elongated belt portion 12 is wrapped so that the strip 25 of connecting gripping material overlaps the strip 28 of connecting material and they are locked together. To more firmly secure the gripping device 10 to the wrist, the rest of the of the elongated belt portion 12 is wrapped around the portion of the gripping device 10 that is already secured to the user's wrist so that the strip 26 of gripping material overlies and is removably affixed to the strip 30 of gripping material.

In use, a person with a hand that is very stiff or immobile can attach gripping device 10 onto the handle of a machine such as exercise devices and thereby be able to operate the machines.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A gripping device that removably attaches onto a user's wrist to enable the user to grip onto a handle of an exercise device, characterized by:

a wrist-wrapping, elongated belt portion having opposite ends and formed from two strips of flexible material having first and second strips of connecting gripping material on one side of the belt portion whereby the first end of the elongated belt portion is wrapped around the user's wrist so that the first strip of connecting gripping material is disposed directly on the back of the user's wrist opposite the palm of the hand and the second opposite end of the elongated belt portion is wrapped around the user's wrist so that the second strip of connecting gripping material overlaps the first strip so that they are locked together;

a gripping structure formed of a stiff and relatively rigid material that extends outward from the plane of the belt portion;

the gripping structure having a lower section, an upper section and a free end section of a unitary construction, the lower section of the gripping structure encased within the two strips of flexible material forming the elongated belt portion;

the gripping structure can be adjusted to change the angle between the lower end section and the upper section, and the free end section of the gripping structure having a tip that generally extends in a direction towards the belt portion and a radius of curvature with respect to the upper section whereby the free end section of the gripping structure can be removably attached to the handle of the exercise device.

2. The gripping device of claim 1 characterized by the flexible strip of material being selected from a material selected from the group comprising leather, plastic or cloth.

3. The gripping device of claim 1 characterized by the upper end section having a centerline Ca-La disposed at an angle a of between 2 and 30 degrees with respect to a centerline C-L extending through the lower end section of the gripping structure.

4. The gripping device of claim 1 characterized in that the gripping structure can be adjusted by changing the radius of curvature of the upper section with respect to the free end section.

5. The gripping device of claim 4 characterized in that the radius of curvature is approximately ½ inch to 1 inch.

6. The gripping device of claim 5 characterized in that the radius of curvature is approximately ¾ inch.

7. The method of removably attaching a gripping device to a user's wrist to enable the user to grip onto a handle of an exercising device, comprising the steps of:

providing a wrist-wrapping, elongated belt portion having opposite ends and formed from two strips of flexible material having first and second strips of connecting gripping material on one side of the belt portion; and providing a gripping structure being stiff and relatively rigid and having a lower section, an upper section and a free end section of a unitary construction;

securing the gripping structure to the elongated belt portion by encasing the lower section of the gripping structure within the two strips of flexible material forming the elongated belt portion; and extending the gripping structure outward from the plane of the belt portion; and providing the free end section of the gripping structure with a radius of curvature with respect to the upper section whereby the free end section of the gripping structure can be removably attached to the handle of the exercise device;

adjusting the angle between the lower end section and the upper section of the gripping structure;

adjusting the radius of curvature of the free end section with respect to the upper section;

attaching the user's hand onto the gripping device so that the one side of the belt portion of the gripping device rests against the user's wrist and the user's hand extends over and curves about the free end portion;

wrapping a first end of the elongated belt portion around the wrist of the user so that a first strip of connecting gripping material is disposed directly on the back of the user's wrist opposite the palm of the hand;

wrapping a second opposite end of the elongated belt portion so that a second strip of connecting gripping material overlaps the first strip and they are locked together; and removably attaching the free end of the gripping structure to the handle of the exercise device.

8. A gripping device that removably attaches onto a user's wrist to enable the user to grip onto a handle of an exercise device, characterized by:

a wrist-wrapping, elongated belt portion having opposite ends and formed from two strips of flexible material having first and second strips of connecting gripping material on one side of the belt portion whereby the first end of the elongated belt portion is wrapped around the user's wrist so that the first strip of connecting gripping material is disposed directly on the back of the user's wrist opposite the palm of the hand and the second opposite end of the elongated belt portion is wrapped around the user's wrist so that the second strip of connecting gripping material overlaps the first strip so that they are locked together;

a gripping structure formed of a stiff and relatively rigid material that extends outward from the plane of the belt portion;

the gripping structure having a lower section, an upper section and a free end section of a unitary construction, the lower section of the gripping structure encased within the two strips of flexible material forming the elongated belt portion;

the gripping structure can be adjusted to change the angle between the lower end section and the upper section, and the free end section of the gripping structure having a tip that generally extends in a direction towards the belt portion and a radius of curvature with respect to the upper section whereby the free end section of the gripping structure can be removably attached to the handle of the exercise device; and characterized in that the stiff and relatively rigid material of the gripping structure is metal.

* * * * *